US011084676B2

(12) United States Patent
Nishioka

(10) Patent No.: US 11,084,676 B2
(45) Date of Patent: Aug. 10, 2021

(54) IMAGE FORMING APPARATUS

(71) Applicant: KYOCERA Document Solutions Inc., Osaka (JP)

(72) Inventor: Nobuhiro Nishioka, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 168 days.

(21) Appl. No.: 16/580,735

(22) Filed: Sep. 24, 2019

(65) Prior Publication Data

US 2020/0102167 A1 Apr. 2, 2020

(30) Foreign Application Priority Data

Sep. 28, 2018 (JP) ..... JP2018-185378

(51) Int. Cl.

| | |
|---|---|
| ***B65H 7/18*** | (2006.01) |
| ***B65H 1/18*** | (2006.01) |
| ***B65H 3/32*** | (2006.01) |
| ***B65H 5/06*** | (2006.01) |
| ***B65H 7/14*** | (2006.01) |
| ***B65H 3/06*** | (2006.01) |
| ***B65H 1/14*** | (2006.01) |

(52) U.S. Cl.

CPC ..... *B65H 7/18* (2013.01); *B65H 1/14* (2013.01); *B65H 1/18* (2013.01); *B65H 3/06* (2013.01); *B65H 3/32* (2013.01); *B65H 5/06* (2013.01); *B65H 7/14* (2013.01); *B65H 2511/152* (2013.01); *B65H 2513/514* (2013.01); *B65H 2553/40* (2013.01)

(58) Field of Classification Search

CPC ... B65H 1/04; B65H 1/08; B65H 1/14; B65H 1/18; B65H 1/266; B65H 3/00; B65H 3/06; B65H 3/0669; B65H 7/00; B65H 7/02; B65H 7/14; B65H 7/18; B65H 7/20; B65H 2511/152; B65H 2513/514; B65H 2553/40

See application file for complete search history.

(56) References Cited

U.S. PATENT DOCUMENTS

| | | | | |
|---|---|---|---|---|
| 2005/0236760 | A1 | 10/2005 | Kang | 271/152 |
| 2013/0026699 | A1 | 1/2013 | Maruta et al. | 271/110 |
| 2016/0355361 | A1* | 12/2016 | Arai | B65H 3/0669 |
| 2019/0256308 | A1* | 8/2019 | Yamashita | B65H 1/266 |

FOREIGN PATENT DOCUMENTS

| | | | |
|---|---|---|---|
| CN | 1690873 | A | 11/2005 |
| CN | 102902177 | A | 1/2013 |
| JP | 8-324804 | A | 12/1996 |

OTHER PUBLICATIONS

Chinese Office Action dated Nov. 18, 2020, issued to corresponding Chinese Application No. 201910912712.3.

* cited by examiner

*Primary Examiner* — Prasad V Gokhale
(74) *Attorney, Agent, or Firm* — Stein IP, LLC

(57) ABSTRACT

An image forming apparatus includes a sheet storing cassette, a lift mechanism, a sheet feeding portion, a remaining quantity sensing portion, and a control portion. The control portion, during continuous sheet feeding by the sheet feeding portion, controls the lift mechanism to make a sheet stacking plate ascend to a lifted position where sheets make contact with the sheet feeding portion, and feeds a foregoing sheet and then, at a sheet feeding timing a predetermined time thereafter, starts feeding the following sheet. The control portion makes the sheet feeding timing earlier as the remaining quantity of the sheets sensed by the remaining quantity sensing portion decreases.

8 Claims, 8 Drawing Sheets

IMAGE FORMING APPARATUS

INCORPORATION BY REFERENCE

This application is based on and claims the benefit of Japanese Patent Application No. 2018-185378 filed on Sep. 28, 2018, the contents of which are hereby incorporated by reference.

BACKGROUND

The present disclosure relates to image forming apparatuses. More particularly, the present disclosure relates to an image forming apparatus provided with a sheet storage cassette including a sheet stacking plate of which an upstream-side part in the sheet feeding direction is swingably supported.

Sheet feeding cassettes (sheet storage cassettes) are used in image forming apparatuses as exemplified by copiers and printers, for the purpose of feeding cut paper sheets and the like. In a sheet feeding cassette, a large number of unprinted sheets are stocked previously, and from the topmost layer of the sheets stacked in it, one sheet after another is fed out separately by a pickup roller, a sheet feeding roller, and the like provided near the sheet feeding cassette.

The sheet feeding cassette includes a sheet stacking plate on the top face of which sheets are stacked. The upstream end of the sheet stacking plate in the sheet feeding direction is supported inside the sheet feeding cassette, and about the point of support as a pivot, the sheet stacking plate is swingable, with a downstream-side end part of it in the sheet feeding direction as a swing end (free end). The sheet feeding cassette also includes a lift mechanism that permits the swing end of the sheet stacking plate to ascend and descend.

In this sheet feeding cassette, as the number of sheets in it decreases, the swing angle of the sheet stacking plate (its inclination angle relative to the horizontal plane) increases. Consequently, the head end position of the topmost sheet when the remaining quantity of sheets is small falls upstream, in the sheet feeding direction, of the head end position of the topmost sheet when the remaining quantity of sheets is large. This results in an increased sheet-to-sheet distance (distance from the tail end of a foregoing sheet to the head end of the following sheet) during continuous sheet feeding.

One solution to the problem is a known sheet feeding cassette in which a tail end cursor for aligning the tail ends of stacked sheets is provided with a pressing member that presses the sheets downstream in the sheet feeding direction and a biasing member that biases the pressing member downstream in the sheet feeding direction. In this sheet feeding cassette, as the remaining quantity of sheets decreases, the pressing member protrudes from the tail end cursor and moves the sheets downstream in the sheet feeding direction. This helps reduce, to a certain degree, the increases in the sheet-to-sheet distance during continuous sheet feeding.

A sheet feeding cassette in which a tail end cursor is provided with a pressing member that presses sheets downstream in the sheet feeding direction and a biasing member that biases the pressing member downstream in the sheet feeding direction is disclosed, for example, in Patent Document 1.

Inconveniently, the above-mentioned conventional sheet feeding cassette with a tail end cursor provided with a pressing member and a biasing member requires a complicated structure in the tail end cursor. Moreover, when and how much the pressing member protrudes from the tail end cursor to move sheets are affected by the stiffness of sheets and the like, and turn out to be unstable.

SUMMARY

According to one aspect of what is disclosed herein, an image forming apparatus includes a sheet storing cassette, a lift mechanism, a sheet feeding portion, a remaining quantity sensing portion, and a control portion. A sheet storing cassette includes a sheet storing portion and a sheet stacking plate. The sheet storing portion stores sheets. The sheet stacking plate, on which the sheets are placed, is supported in the sheet storing portion so as to be ascendable and descendable about a swing pivot on the upstream side in the sheet feeding direction. The lift mechanism makes the sheet stacking plate ascend and descend. The sheet feeding portion feeds the sheets to a sheet conveying passage. The remaining quantity sensing portion senses the remaining quantity of sheets in the sheet feeding cassette. The control portion controls the sheet feeding portion. During continuous feeding of the sheets by the sheet feeding portion, the control portion controls the lift mechanism to make the sheet stacking plate ascend to a lifted position where the sheets make contact with the sheet feeding portion and feeds a foregoing sheet and then, at a sheet feeding timing a predetermined time thereafter, starts feeding the following sheet. The control portion makes the sheet feeding timing earlier as the remaining quantity of the sheets sensed by the remaining quantity sensing portion decreases.

This and other objects of the present disclosure, and the specific benefits obtained according to the present disclosure, will become apparent from the description of embodiments which follows.

DETAILED DESCRIPTION

An embodiment of the present disclosure will be described below with reference to the accompanying drawings.

Figure 1:
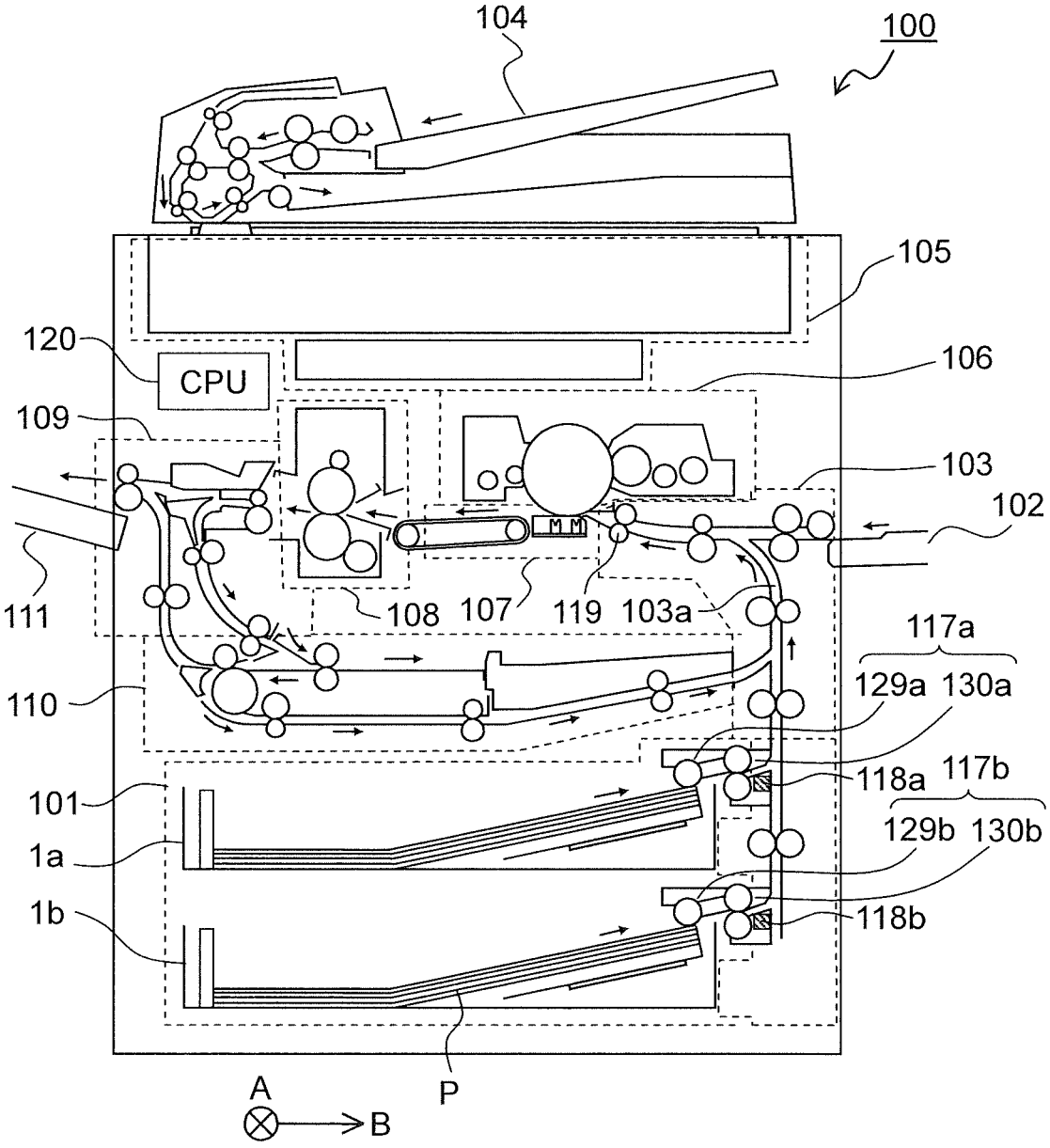
FIG. 1 is a sectional view showing the internal structure of an image forming apparatus according to an embodiment of the present disclosure.

FIG. 1 is a sectional view showing the internal structure of an image forming apparatus 100 according to one embodiment of the present disclosure. In the diagram, solid-line arrows indicate the conveying path and the conveying direction of sheets.

In FIG. 1, in a lower part of the image forming apparatus 100, a cassette mount portion (mount portion) 101 is arranged. In the cassette mount portion 101, two sheet feeding cassettes (sheet storage cassettes) 1*a* and 1*b* are mounted. Inside the sheet feeding cassettes 1*a* and 1*b*, bundles of sheets P, such as unprinted cut paper sheets, are stacked, and by sheet feeding units (feeding portions) 117*a* and 117*b* provided in the main body of the image forming apparatus 100, sheets P are fed out one by one from the bundles of sheets P. The sheet feeding unit 117*a* includes, for the sheet feeding cassette 1*a*, a pickup roller 129*a* and a sheet feeding roller pair (a feeding roller pair) 130*a*. The sheet feeding unit 117*b* includes, for the sheet feeding cassette 1*b*, a pickup roller 129*b*, and a sheet feeding roller pair (a feeding roller pair) 130*b*.

A manual feed tray 102 is provided outside an upper part of the right side face of the image forming apparatus 100. The manual feed tray 102 is for placement of sheets of a different size or thickness from the sheets in the sheet feeding cassettes 1*a* and 1*b*, or sheets that are fed in one at a time, such as OHP sheets, envelopes, postcards, and invoices.

Inside the image forming apparatus 100, a sheet conveying portion 103 is arranged. The sheet conveying portion 103 is located to the right, that is, on the downstream side in the sheet feeding direction, of the cassette mount portion 101, and is located to the left, that is, on the downstream side in the sheet feeding direction, of the manual feed tray 102. Sheets P fed out of the sheet feeding cassettes 1*a* and 1*b* are conveyed vertically upward along a side face of the main body of the image forming apparatus 100 by the sheet conveying portion 103, and sheets P fed out of the manual feed tray 102 are conveyed horizontally.

On the top face of the image forming apparatus 100, a document conveying device 104 is arranged, and under it, an image reading portion 105 is arranged. When copying a document, a user places the document, comprising a plurality of sheets, on the document conveying device 104. The document conveying device 104 feeds out one sheet after another separately from the document, and the image reading portion 105 reads its image data.

On the downstream side of the sheet conveying portion 103 in the sheet conveying direction under the image reading portion 105, an image forming portion 106 and a transfer portion 107 are arranged. At the image forming portion 106, based on the image data read by the image reading portion 105, an electrostatic latent image of the document image is formed. This electrostatic latent image is developed to form a toner image. On the other hand, in synchronism with the timing of the toner image formation at the image forming portion 106, a sheet P is conveyed from the sheet feeding cassettes 1*a* and 1*b* to the transfer portion 107 via a registration roller pair 119 of the sheet conveying portion 103. The toner image formed at the image forming portion 106 is transferred to the sheet P at the transfer portion 107.

On the downstream side of the transfer portion 107, a fixing portion 108 is arranged. The sheet P to which the toner image has been transferred at the transfer portion 107 is conveyed to the fixing portion 108, and as the sheet P passes through a nip portion in a fixing roller pair comprising a heating roller and a pressure roller, the unfixed toner image is fixed to the sheet P to become a permanent image.

On the downstream side of the fixing portion 108, near the left side face of the image forming apparatus 100, a discharge/branch portion 109 is arranged. The sheet P discharged from the fixing portion 108 is, when no double-sided printing is performed, discharged from the discharge/branch portion 109 onto a sheet discharge tray 111 provided outside the left side face of the image forming apparatus 100.

Over the cassette mount portion 101, a two-side printing unit 110 is arranged. When two-side printing is performed, sheets P discharged from the fixing portion 108 are fed to the display printing unit 110 via the discharge/branch portion 109. The sheets P fed to the display printing unit 110, with its obverse and reverse sides reversed by switch-back, passes through the sheet conveying portion 103 again to be conveyed to the transfer portion 107 with the unprinted side up.

The image forming apparatus 100 is provided also with a control portion 120 which controls driving of different portions constituting the image forming apparatus 100 such as the cassette mount portion 101, the sheet conveying portion 103, the image reading portion 105, the image forming portion 106, the transfer portion 107, and the fixing portion 108.

Figure 2:
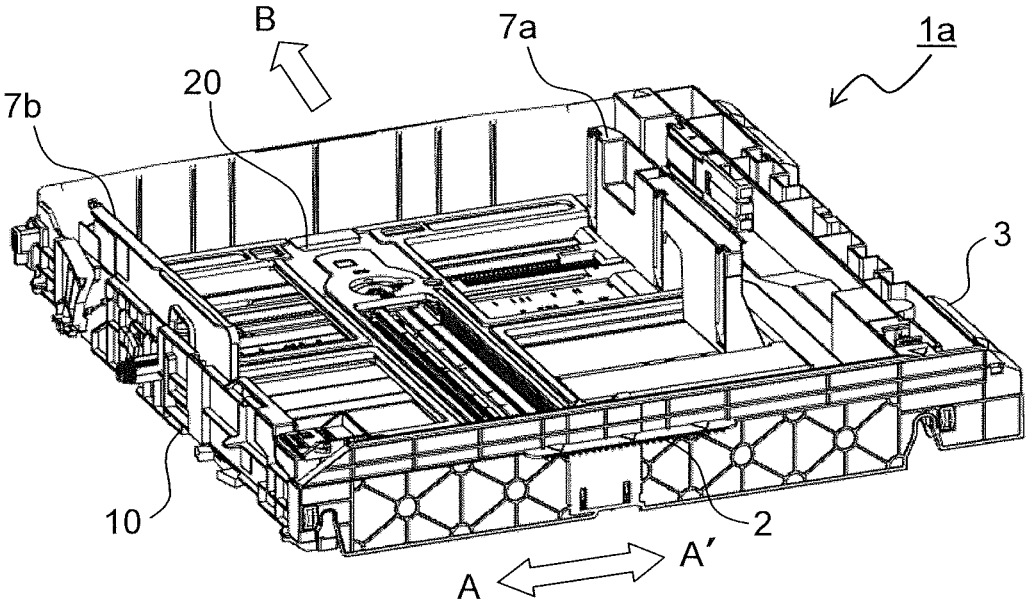
FIG. 2 is an exterior perspective view of a sheet feeding cassette in the image forming apparatus according to the embodiment of the present disclosure, as seen from upstream in the sheet feeding direction, from obliquely above.
Figure 3:
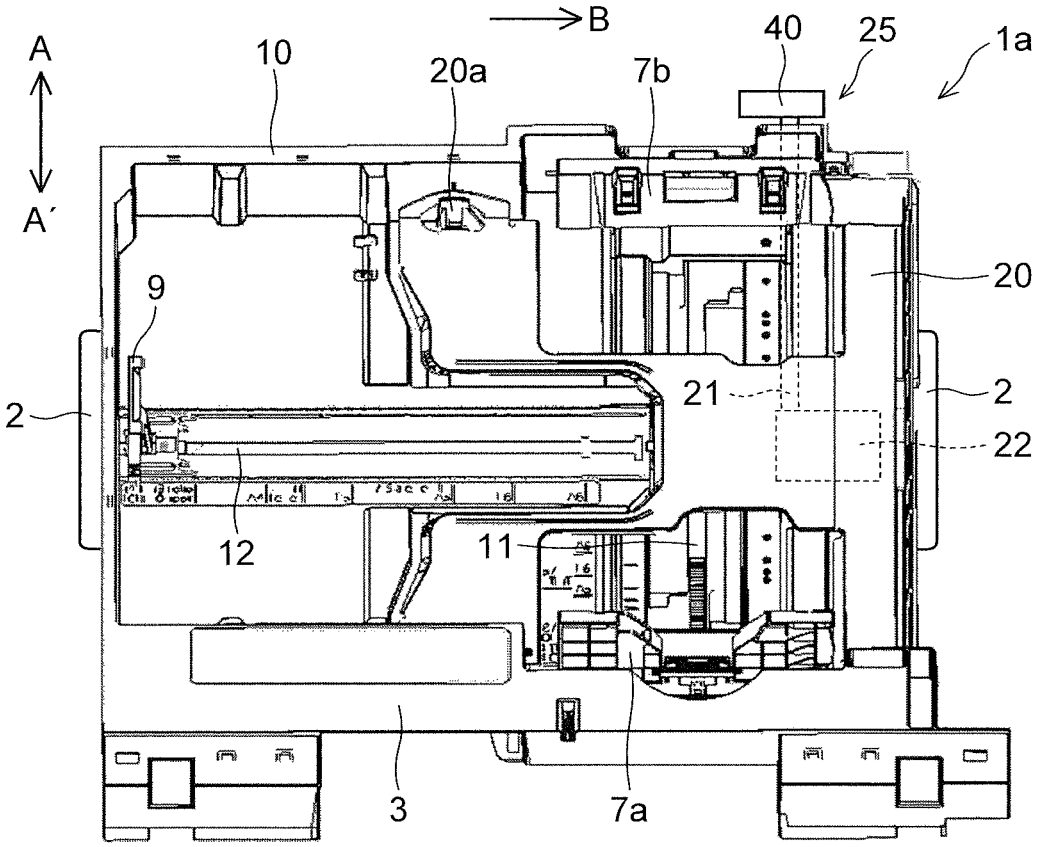
FIG. 3 is an exterior perspective view of the sheet feeding cassette in the image forming apparatus according to the embodiment of the present disclosure, as seen from the extraction direction.

Next, the structure of the sheet feeding cassette 1*a* removably mounted in the image forming apparatus 100 will be described in detail with reference to FIGS. 2 and 3. FIG. 2 is an exterior perspective view of the sheet feeding cassette 1*a* as seen from the upstream side in the sheet feeding direction, from above. FIG. 3 is an exterior perspective view of the sheet feeding cassette 1*a* as seen from the extraction direction (arrow A' direction). Although the following description deals with the structure of the sheet feeding cassette 1*a*, the sheet feeding cassette 1*b* has quite the same structure. In FIGS. 2 and 3, the insertion direction of the sheet feeding cassette 1*a* with respect to the cassette mount portion 101 is indicated by arrow A, the extraction direction is indicated by arrow A', and the sheet feeding direction with respect to the sheet feeding cassette 1*a* is indicate by arrow B. In FIG. 1, the sheet feeding direction is a direction pointing from the near side to the far side of the plane of FIG. 1.

The sheet feeding cassette 1*a* is mounted in the cassette mount portion 101 in the image forming apparatus 100. A cassette base (sheet storing portion) 10 that constitutes the main body portion of the sheet feeding cassette 1*a* is composed of a flat box open at its top face, and a bundle of sheets P is stored in it from above. In the cassette mount portion 101 inside the image forming apparatus 100, above the sheet feeding cassette 1*a*, a sheet feeding unit 117*a* (see FIG. 1) is provided, and sheets P (see FIG. 1) are fed in arrow B direction shown in FIG. 2. To a front portion of the cassette base 10, a cassette cover 3 is attached. The cassette cover 3, with its obverse side (on the right of FIG. 3) exposed to outside, forms a part of the exterior face of the image forming apparatus 100 main body.

The sheet feeding cassette 1*a* is inserted in the cassette mount portion 101 by being horizontally slid in the arrow A direction shown in FIG. 2 with guide ribs 2 provided outside those side faces of the cassette base 10 which are parallel to the removing and inserting directions (arrow AA' directions) engaged with unillustrated rails inside the cassette mount portion 101.

A sheet stacking plate 20 on which sheets P are stacked is a plate-like member and is provided such that the downstream end in the sheet feeding direction (arrow B direction) is ascendable/descendable with respect to the cassette base 10 with stacking plate supporting portions 20*a* on both sides in the sheet width direction (arrow AA' direction) acting as pivots. The stacking plate supporting portions 20*a* are provided at an end part on the upstream side of the sheet stacking plate 20 in the sheet feeding direction and are fixed to the cassette base 10.

On both sides of the sheet stacking plate 20 in its width direction, there is provided a pair of width regulation cursors 7*a* and 7*b* for positioning, in the width direction, the sheets P stacked on the sheet stacking plate 20 so as to be reciprocatable in the sheet width direction (arrow AA' direction) along a width regulation cursor guide groove formed in the cassette base 10. Due to an unillustrated coordination mechanism provided under the pair of width regulation cursors 7*a* and 7*b*, when one of the pair is moved, also the other is moved in coordination. Here, the pair of width regulation cursors 7*a* and 7*b* moves symmetrically with each other about the middle line of sheets P in the width direction.

The sheet feeding cassette 1*a* includes a tail end cursor 9 which, by being arranged at a position corresponding to the size of sheets P, makes contact with and aligns the tail end of the sheets P stacked on the sheet stacking plate 20. Sheets P are conveyed in arrow B direction toward the sheet conveying portion 103 (see FIG. 1), and thus the tail end cursor 9 for aligning the tail ends of the sheets P is provided so as to be reciprocatable in the sheet feeding direction (arrow B direction) along a tail end cursor guide groove 12 formed in the cassette base 10.

By moving the width regulation cursors 7*a* and 7*b* and the tail end cursor 9 according to the size of sheets P stacked on the sheet stacking plate 20, the sheets P are stored in a predetermined position inside the sheet feeding cassette 1*a*. The sheet stacking plate 20 has notches formed along the moving ranges of the width regulation cursors 7*a* and 7*b* and the tail end cursor 9.

Figure 4:
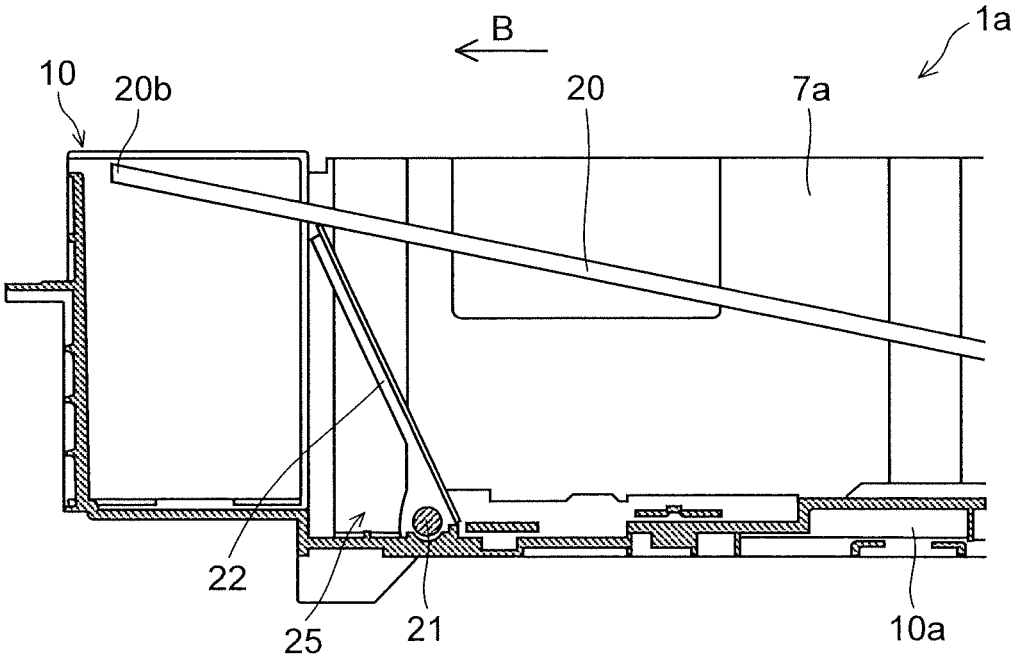
FIG. 4 is a side sectional view showing the structure around a swing end of a sheet stacking plate in the sheet feeding cassette in the image forming apparatus according to the embodiment of the present disclosure.

As shown in FIG. 4, under the sheet stacking plate 20 near a swing end 20*b* of it, a swing shaft 21 is arranged. The swing shaft 21 is rotatably supported on two bearing portions (unillustrated) formed on a bottom face portion 10*a* of the cassette base 10. The bearing portions (unillustrated) are arranged, of the bottom face portion 10*a*, at an end part in arrow A direction in FIG. 3 and at a middle part in arrow AA' direction (sheet width direction). To one end of the swing shaft 21 (an end part in the arrow A' direction in FIG. 3), a base end portion of a metal actuating plate 22 is fixed. The actuating plate 22 is arranged at a position facing a substantially middle part, in the sheet width direction, of the back side of the sheet stacking plate 20.

Figure 5:
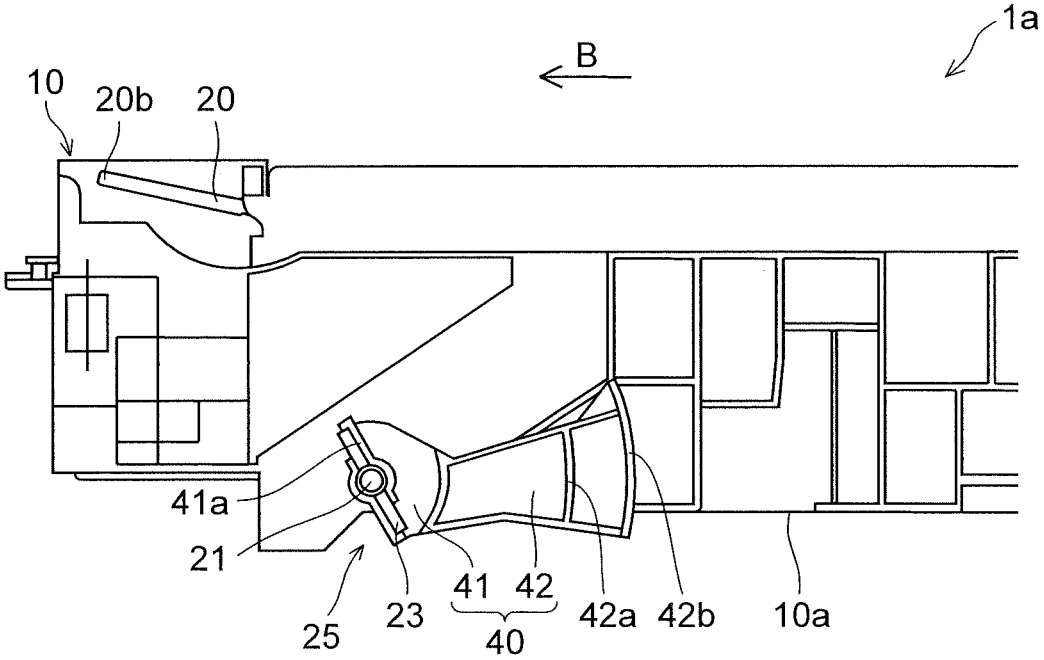
FIG. 5 is a side view showing the structure around a lift mechanism in the sheet feeding cassette in the image forming apparatus according to the embodiment of the present disclosure, showing the position of an actuator as observed when an actuating plate and the sheet stacking plate are arranged at the highest position.

The other end of the swing shaft 21 (an end part in arrow A direction in FIG. 3), as shown in FIG. 5, projects outside the cassette base 10, and to that end is fixed an engagement pin 23 extending in a direction perpendicular to the swing shaft 21. In the cassette mount portion 101 (see FIG. 1), at a position facing the engagement pin 23, a coupling member on the main body side (unillustrated) is provided. The coupling member on the main body side transmits a rotation driving force of a lift driving source (unillustrated) provided in the image forming apparatus 100 main body to the sheet feeding cassette 1*a*. The engagement pin 23, with the sheet feeding cassette 1*a* mounted in the cassette mount portion 101, couples with a claw portion of the coupling member on the main body side to form a coupling portion. With this, the rotation driving force is fed in from the coupling member on the main body side. The actuating plate 22, the swing shaft 21, and the engagement pin 23 form a lift mechanism 25. That is, the lift mechanism 25 includes the swing shaft 21 extending in the sheet width direction orthogonal to the sheet feeding direction and the actuating plate 22 which swings about the swing shaft 21 and makes contact with the back side of the sheet stacking plate 20. The lift mechanism 25 makes the sheet stacking plate 20 ascend and descend between a lifted position at which it feeds out sheets P and a lowered position at which it is supplied (replenished) with sheets P.

FIGS. 4 and 5 show a state where the swing end 20*b* of the sheet stacking plate 20 is lifted by the tip end portion of the actuating plate 22. However, when the engagement pin 23 of the swing shaft 21 is not engaged with the coupling member on the main body side (unillustrated), the actuating plate 22 is arranged at a laid position along the bottom face portion 10*a* of the cassette base 10 (a position rotated counter-clockwise from the state in FIG. 4). Also the swing end 20*b* of the sheet stacking plate 20 is lowered to the lowest position.

Figure 6:
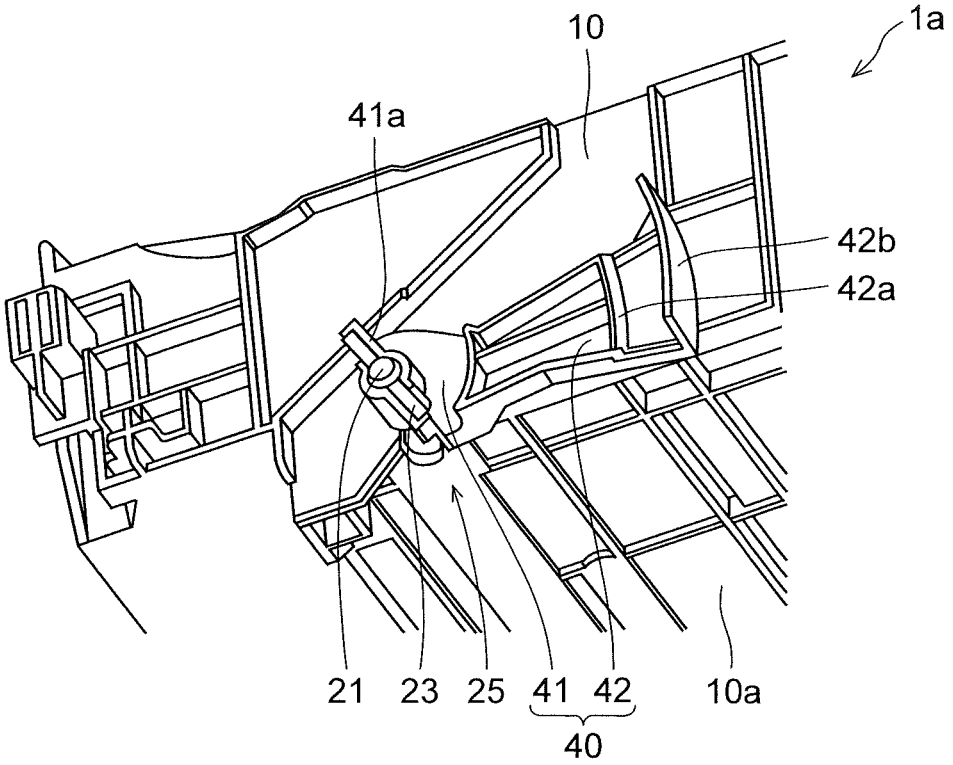
FIG. 6 is a perspective view showing the structure around the lift mechanism in the sheet feeding cassette in the image forming apparatus according to the embodiment of the present disclosure.

As shown in FIGS. 5 and 6, an actuator (a light shielding member) 40 for sensing the remaining quantity of sheets in the sheet feeding cassette 1*a* is fixed to the other end of the swing shaft 21. The actuator 40 is formed of a mount portion 41 fitted to the swing shaft 21 and a fan portion (arm portion) 42 extending in the radial direction of the swing shaft 21. That is, the actuator 40 includes the fan portion 42, and the fan portion 42 extends in the radial direction from one end of the swing shaft 21 to rotate together with the swing shaft 21.

In the mount portion 41, a lock portion 41*a* is formed which has a locking groove in which the engagement pin 23 is fitted. This permits the actuator 40 to rotate together with the engagement pin 23 and the swing shaft 21.

Figure 7:
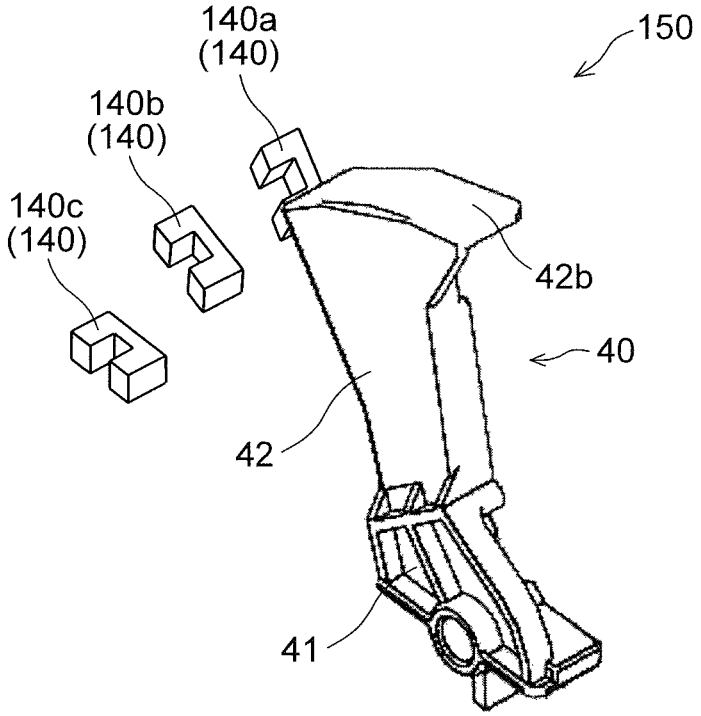
FIG. 7 is a perspective view showing the structure of a remaining quantity sensing portion in the image forming apparatus according to the embodiment of the present disclosure.
Figure 8:
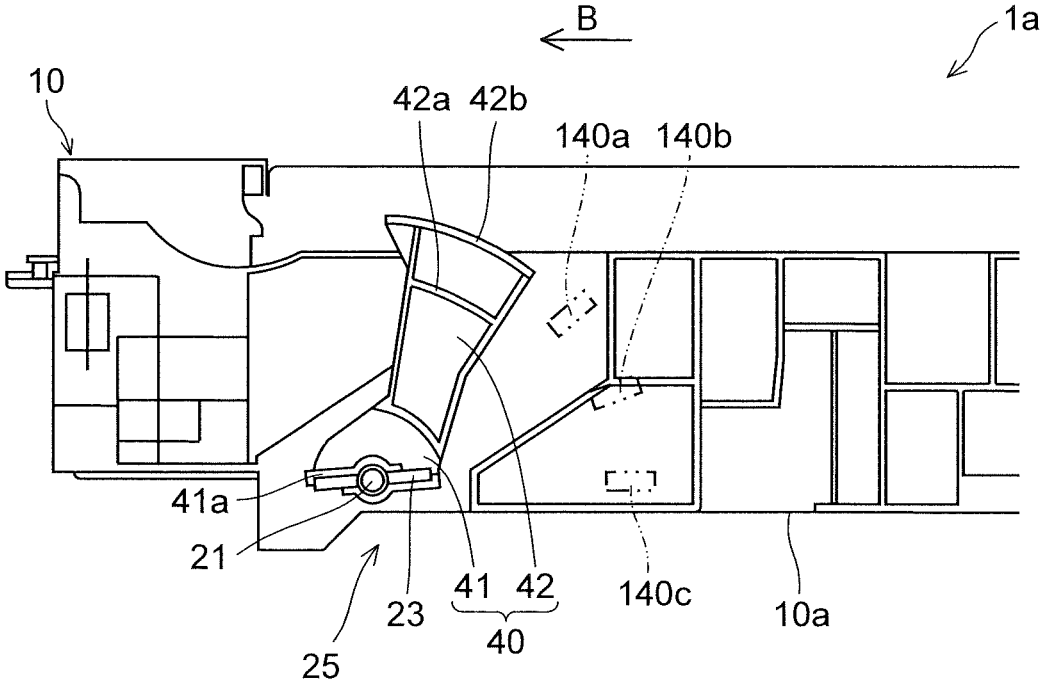
FIG. 8 is a side view showing the structure around the lift mechanism in the sheet feeding cassette in the image forming apparatus according to the embodiment of the present disclosure, showing the position of the actuator as observed when the actuating plate and the sheet stacking plate are arranged at the lowest position.

In the fan portion 42, a reinforcing rib 42*a* and an arc rib 42*b*, which is a light shielding portion, are formed. The arc rib 42*b* is provided on a circumferential portion at a tip end of the fan portion 42 and projects in the axial direction of the swing shaft 21 (insertion direction of the sheet feeding cassette 1*a* (arrow A direction)). The cassette mount portion 101 is, as shown in FIGS. 7 and 8, provided with U-shaped remaining quantity sensors 140 having a light emitting portion and a light receiving portion (neither of them illustrated) which are arranged so as to face each other across the arc rib 42*b* in the radial direction. The remaining quantity sensor 140 and the actuator 40 form the remaining quantity sensing portion 150 for sensing the remaining quantity of sheets P in the sheet feeding cassette 1*a*. That is, a plurality of remaining quantity sensors 140 are arranged on the cassette mount portion 101 along the swing locus of the tip end of the fan portion 42. The control portion 120 can sense the remaining quantity of sheets in a plurality of steps.

The three remaining quantity sensors 140 (140*a* to 140*c*) are arranged along the track of the arc rib 42*b*. When the remaining quantity of sheets on the sheet stacking plate 20 changes and the swing shaft 21 and the actuator 40 rotate, the optical path between the light emitting portion and the light receiving portion is switched between an open state and a shielded state. Thus, when three remaining quantity sensors 140*a* to 140*c* are used, the remaining quantity of sheets P on the sheet stacking plate 20 can be sensed in four steps (OFF/OFF/OFF, ON/OFF/OFF, ON/ON/OFF, ON/ON/ON).

Specifically, the sheet feeding cassette 1*a* can accommodate sheets P up to about 500 sheets. When the sheet feeding cassette 1*a* is stacked with about 500 sheets P, the sheet feeding cassette 1*a* is in the state shown in FIGS. 8 and 9. Here, the optical paths of the remaining quantity sensors 140*a* to 140*c* are in an open state (OFF/OFF/OFF). The inclination angle of the sheet stacking plate 20 is about one degree. The head end position P1 of the topmost sheet P in this state (see FIG. 9) is referred to as a head end reference position.

Figure 9:
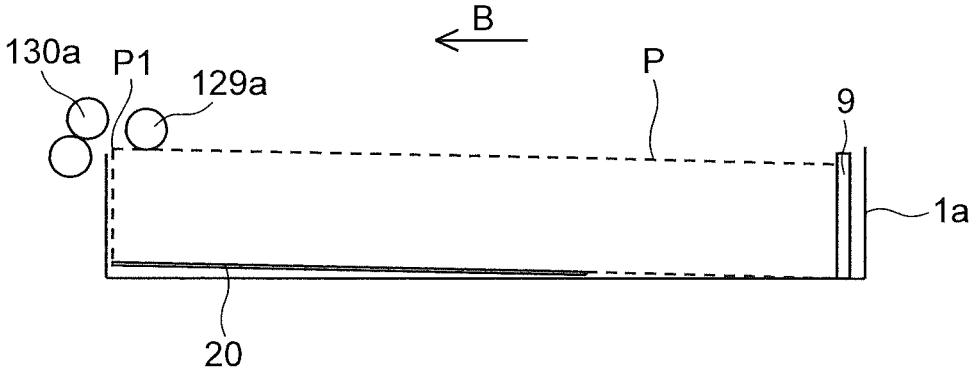
FIG. 9 is a diagram showing a state where, with about 500 sheets stacked on the sheet stacking plate in the image forming apparatus according to the embodiment of the present disclosure, the topmost sheet is in pressed contact with a pickup roller.
Figure 10:
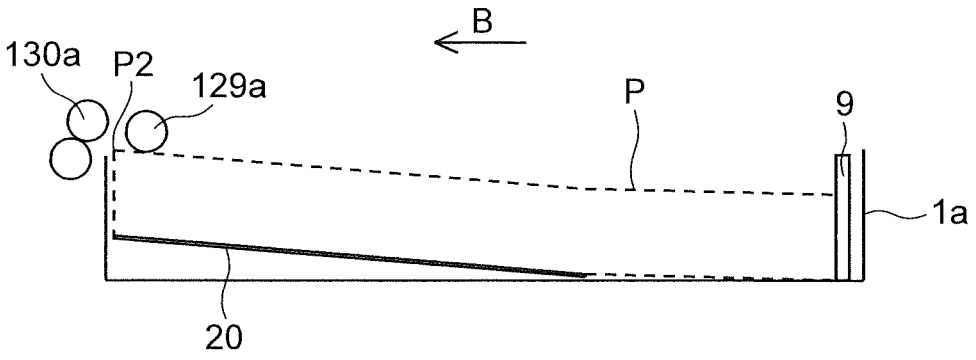
FIG. 10 is a diagram showing a state where, with about 375 sheets stacked on the sheet stacking plate in the image forming apparatus according to the embodiment of the present disclosure, the topmost sheet is in pressed contact with the pickup roller.

When, from the state shown in FIGS. 8 and 9, sheets P stacked on the sheet stacking plate 20 are fed out and the remaining quantity of sheets on the sheet stacking plate 20 reduces to 375, the sheet feeding cassette 1*a* goes into the state shown in FIG. 10. Here, the optical path of the remaining quantity sensors 140*a* is shielded from light by the arc rib 42*b* and is in a light shielding state, and the optical paths of the remaining quantity sensors 140*b* and 140*c* are in an open state (ON/OFF/OFF). Here, the inclination angle of the sheet stacking plate 20 is about 4.5 degrees, and the head end position P2 of the topmost sheet P is, compared to the head end reference position P1 (see FIG. 9), located 2 mm upstream in the sheet feeding direction.

Figure 11:
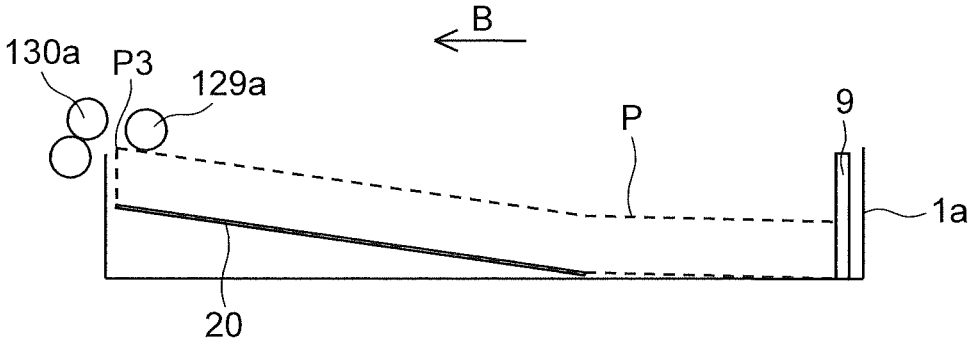
FIG. 11 is a diagram showing a state where, with about 250 sheets stacked on the sheet stacking plate in the image forming apparatus according to the embodiment of the present disclosure, the topmost sheet is in pressed contact with the pickup roller.
Figure 12:
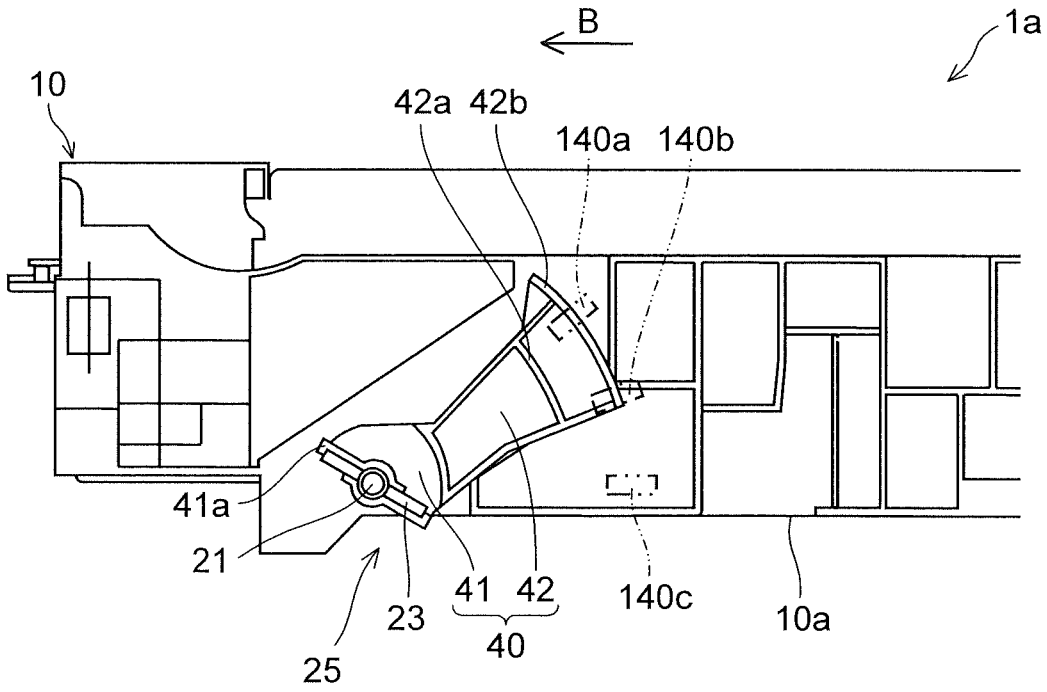
FIG. 12 is a side view showing the structure around the lift mechanism in the sheet feeding cassette in the image forming apparatus according to the embodiment of the present disclosure, showing the position of the actuator as observed in the state where about 250 sheets are stacked on the sheet stacking plate.

When, from the state shown in FIG. 10, sheets P stacked on the sheet stacking plate 20 are fed out and the remaining quantity of sheets on the sheet stacking plate 20 reduces to 250, the sheet feeding cassette 1*a* goes into the state shown in FIGS. 11 and 12. Here, the optical paths of the remaining quantity sensors 140*a* and 140*b* are shielded from light by the arc rib 42*b* and are in a light shielding state, and the optical path of the remaining quantity sensor 140*c* is in an open state (ON/ON/OFF). Here, the inclination angle of the sheet stacking plate 20 is about 8 degrees, and the head end position P3 of the topmost sheet P is, compared to the head end reference position P1 (see FIG. 9), located 4 mm upstream in the sheet feeding direction.

Figure 13:
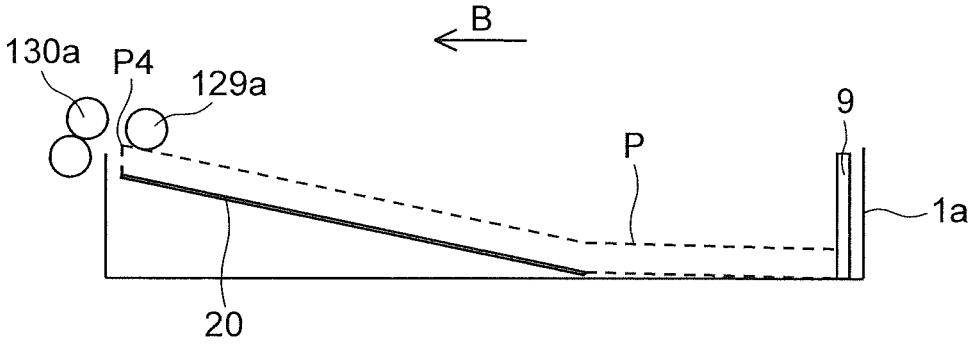
FIG. 13 is a diagram showing a state where, with about 125 sheets stacked on the sheet stacking plate in the image forming apparatus according to the embodiment of the present disclosure, the topmost sheet is in pressed contact with the pickup roller.

When, from the state shown in FIGS. 11 and 12, sheets P stacked on the sheet stacking plate 20 are fed out and the remaining quantity of sheets on the sheet stacking plate 20 reduces to 125, the sheet feeding cassette 1*a* goes into the state shown in FIG. 13. Here, the optical paths of the remaining quantity sensors 140*a* to 140*c* are shielded from light by the arc rib 42*b* and are in a light shielding state (ON/ON/ON). Here, the inclination angle of the sheet stacking plate 20 is about 11.5 degrees, and the head end position P4 of the topmost sheet P is, compared to the head end reference position P1 (see FIG. 9), located 6 mm upstream in the sheet feeding direction.

Figure 14:
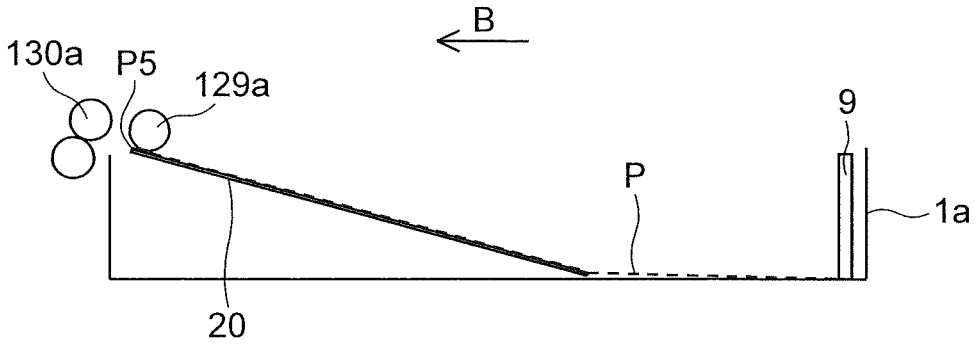
FIG. 14 is a diagram showing a state where, with about one sheet stacked on the sheet stacking plate in the image forming apparatus according to the embodiment of the present disclosure, the topmost sheet is in pressed contact with the pickup roller.

When, from the state shown in FIG. 13, sheets P stacked on the sheet stacking plate 20 are fed out and the remaining quantity of sheets on the sheet stacking plate 20 reduces to about one, the sheet feeding cassette 1*a* goes into the state shown in FIG. 14. Here, the optical paths of the remaining quantity sensors 140*a* to 140*c* remain shielded from light (ON/ON/ON). The inclination angle of the sheet stacking plate 20 is about 15 degrees, and the head end position P5 of the topmost sheet P is, compared to the head end reference position P1, located about 8 mm upstream in the sheet feeding direction.

Hereinafter, the state where the optical paths of the remaining quantity sensors 140*a* to 140*c* are open (OFF/OFF/OFF, with the remaining quantity of sheets about 500 to about 376) is referred to as a first state, the state where only the optical path of the remaining quantity sensor 140*a* is shielded from light (ON/OFF/OFF, with the remaining quantity of sheets about 375 to about 251) is referred to as a second state, the state in which only the optical path of the remaining quantity sensor 140*c* is open (ON/ON/OFF, with the remaining quantity of sheets about 250 to about 126) is referred to as a third state, and the state in which the optical paths of the remaining quantity sensors 140*a* to 140*c* are shield from light (ON/ON/ON, with the remaining quantity of sheets about 125 to about 1) is referred to as a fourth state. In this way, using the three remaining quantity sensors 140*a* to 140*c*, the remaining quantity of sheets P on the sheet stacking plate 20 can be sensed in four steps (the first, second, third, and fourth states).

Here, as shown in FIG. 1, in the sheet conveying passage 103*a* in the sheet conveying portion 103, sheet detection sensors 118*a* and 118*b* for sensing sheets P are provided. In this embodiment, the sheet detection sensors 118*a* and 118*b* are arranged close to downstream-side parts, in the sheet conveying direction, of the sheet feeding roller pair 130*a* and 130*b* respectively. The sheet detection sensors 118*a* and 118*b* sense the tail end of a sheet P fed by the sheet feeding roller pair 130*a* and 130*b*.

The control portion 120, during continuous sheet feeding, makes the sheet feeding units 117*a* and 117*b* start to feed out sheets P at a sheet feeding timing a predetermined time after the detection of the foregoing sheet P by the sheet detection sensors 118*a* and 118*b*.

Although the following description deals with a case where sheets P in the sheet feeding cassette 1*a* are fed out, it applies also in a case where sheets P in the sheet feeding cassette 1*b* are fed out, and thus no overlapping description will be repeated.

The control portion 120, during continuous sheet feeding, makes the sheet feeding timing of the sheet feeding unit 117*a* starting sheet feeding earlier as the remaining quantity of sheets in the sheet feeding cassette 1*a* decreases. Here, the control portion 120, during continuous sheet feeding, makes the sheet feeding timing earlier stepwise as the remaining quantity of sheets in the sheet feeding cassette 1*a* decreases (as the remaining quantity sensors 140*a* to 140*c* shift from the first state to the second state, to the third state, and then to the fourth state).

Specifically, the control portion 120, in the first state (with the remaining quantity of sheets about 500 to about 376), makes the pickup roller 129*a* start sheet feeding at a timing a predetermined reference time after the detection of a sheet P by the sheet detection sensor 118*a*.

The control portion 120, in the second state (with the remaining quantity of sheets about 375 to about 251), makes the pickup roller 129*a* start sheet feeding before the above-mentioned reference time passes after the detection of a sheet P by the sheet detection sensor 118*a*. Here, the line speed of the sheet feeding unit 117*a* is 250 mm/sec, and thus the feeding by the pickup roller 129*a* starts 8 msec earlier. Thus, sheets P are displaced 2 mm (that is, 250 mm/sec×8 msec) downstream in the sheet feeding direction.

The control portion 120, in the third state (with the remaining quantity of sheets about 250 to about 126), makes the pickup roller 129*a* start sheet feeding at a timing earlier than in the second state. Here, the feeding by the pickup roller 129*a* starts 16 msec earlier. Thus, sheets P are displaced 4 mm (that is, 250 mm/sec×16 msec) downstream in the sheet feeding direction.

The control portion 120, in the fourth state (with the remaining quantity of sheets: about 125 to about 1), makes the pickup roller 129*a* start sheet feeding at a timing earlier than in the third state. Here, the feeding by the pickup roller 129*a* starts 24 msec earlier. Thus, sheets P are displaced 6 mm (that is, 250 mm/sec×24 msec) downstream in the sheet feeding direction.

Through correction of the sheet feeding timing as described above, even when the remaining quantity of sheets on the sheet stacking plate 20 has decreased until the head end position of the topmost sheet P is located on the upstream side of the head end reference position P1 in the sheet feeding direction, the increase in the sheet-to-sheet distance is suppressed to be about zero to about two millimeters.

In this embodiment, as described above, the control portion 120, during continuous sheet feeding, makes the sheet feeding timing of the sheet feeding units 117*a* and 117*b* starting sheet feeding earlier as the remaining quantity of sheets in the sheet feeding cassettes 1*a* and 1*b* decreases. This helps suppress the increase in the sheet-to-sheet distance (the distance from the tail end of a foregoing sheet P to the head end of the following sheet) during continuous sheet feeding. It is also possible, unlike with conventional sheet feeding cassettes, to adjust the sheet feeding timing without being affected by the stiffness of sheets P.

There is no need to provide the tail end cursor 9 with a pressing member for pressing sheets P downstream in the sheet feeding direction or a biasing member for biasing the pressing member downstream in the sheet feeding direction, and this helps suppress complicating the structure of the tail end cursor 9.

Owing to the features described above, with the image forming apparatus 100 according to the embodiment, it is possible, with a simple structure, to accurately suppress an increase in the sheet-to-sheet distance during continuous sheet feeding.

Moreover, as described above, the control portion 120 makes the sheet feeding timing earlier stepwise each time the remaining quantity of sheets P in the sheet feeding cassettes 1*a* and 1*b* decreases by a predetermined number of sheets (here, about 125 sheets). This allows easy adjustment of the sheet feeding timing in accordance with the remaining quantity of sheets in the sheet feeding cassettes 1*a* and 1*b*.

Moreover, as described above, the remaining quantity sensing portion 150 includes an actuator 40 that moves in coordination with the ascent and descent of the sheet stacking plate 20 and remaining quantity sensors 140 that sense the remaining quantity of sheets in the sheet feeding cassettes 1*a* and 1*b* as a result of optical paths being opened and shielded by the actuator 40. It is thus possible to easily sense the remaining quantity of sheets in the sheet feeding cassettes 1*a* and 1*b*.

Moreover, as described above, the sheet detection sensors 118*a* and 118*b* are arranged close to downstream-side parts, in the sheet conveying direction, of the sheet feeding roller pair 130*a* and 130*b* respectively, and sense the tail ends of sheets P. This makes it possible to sense sheets P at a position closer to the sheet feeding units 117*a* and 117*b*, and thus to suppress more accurately an increase in the sheet-to-sheet distance during continuous sheet feeding.

It should be understood that the embodiments disclosed herein are in every aspect illustrative and not restrictive. The scope of the present disclosure is not limited by the description of the embodiments given above but by the appended claims, and encompasses any modifications made within a sense and scope equivalent to those of the claims.

For example, although the above description deals with an example where the present disclosure is applied to a monochrome multifunction peripheral as shown in FIG. 1, this is not meant to limit the present disclosure. Needless to say, the present disclosure is applicable to various image forming apparatuses provided with a sheet storage cassette having a sheet stacking plate, such as color multifunction peripherals, monochrome printers, color printers, monochrome copiers, color copiers, and facsimile machines. In image forming apparatuses provided with an intermediate transfer belt to which a toner image is primarily transferred from a photosensitive member, a delay in sheet conveying resulting from an increased sheet-to-sheet distance produces a wait time corresponding to the time that the intermediate transfer belt requires to make one turn; this makes the application of the present disclosure there especially effective.

Although the above embodiment deals with an example where a remaining quantity sensing portion 150 including remaining quantity sensors 140 and an actuator 40 is used, this is not meant to limit the present disclosure; instead, any of various types of remaining quantity sensing portion may be used. For example, it is possible to use a remaining quantity sensing portion including an optical sensor or the like that senses the height position of an upstream-side end part of the top face of the sheets P in the sheet feeding cassettes 1*a* and 1*b* or the height position of a downstream-side end part of the bottom face of the sheet stacking plate 20.

Although the above embodiment deals with an example where the sheet feeding cassettes 1*a* and 1*b* are provided with sheet detection sensors 118*a* and 118*b* respectively, this is not meant to limit the present disclosure. Instead, for example, for the sheet feeding cassettes 1*a* and 1*b*, a single sheet detection sensor 118*a* may be provided to be shared between them. With this configuration, it is possible to suppress an increase in the number of components. In that case, the sheet detection sensor 118*a* can be arranged between the sheet feeding roller pair 130*a* and the registration roller pair 119.

Although the above embodiment deals with an example where the sheet detection sensor 118*a* senses the tail end of a sheet P, it may instead sense the head end of a sheet P.

Although the above embodiment deals with an example where the remaining quantity of sheets on the sheet stacking plate 20 is sensed in four steps, this is not meant to limit the present disclosure; instead, the remaining quantity of sheets on the sheet stacking plate 20 may be sensed in two, three, or five or more steps.

What is claimed is:

1. An image forming apparatus, comprising:

a sheet storing cassette including a sheet storing portion in which sheets are stored, and a sheet stacking plate on which the sheets are placed, the sheet stacking plate being supported in the sheet storing portion so as to be ascendable and descendable about a swing pivot on an upstream side in a sheet feeding direction;

a lift mechanism which makes the sheet stacking plate ascend and descend;

a sheet feeding portion which feeds the sheets to a sheet conveying passage;

a remaining quantity sensing portion which senses a remaining quantity of the sheets in the sheet feeding cassette; and a control portion which controls the sheet feeding portion, wherein during continuous feeding of the sheets by the sheet feeding portion, the control portion controls the lift mechanism to make the sheet stacking plate ascend to a lifted position where the sheets make contact with the sheet feeding portion, and the sheet feeding portion to feed a following sheet of the sheets at a sheet feeding timing after a foregoing sheet of the sheets is fed, and makes the sheet feeding timing earlier as the remaining quantity of the sheets sensed by the remaining quantity sensing portion decreases.

2. The image forming apparatus according to claim 1, wherein the control portion, during continuous sheet feeding, makes the sheet feeding timing earlier stepwise as the remaining quantity of the sheets decreases.

3. The image forming apparatus according to claim 1, wherein the remaining quantity sensing portion includes a light shielding member which moves in coordination with ascent and descent of the sheet stacking plate, and an optical sensor which senses the remaining quantity of sheets in the sheet storing cassette as a result of an optical path being opened and shielded by the light shielding member.

4. The image forming apparatus according to claim 3, further comprising a mount portion in which the sheet storing cassette can be mounted, wherein the lift mechanism includes a swing shaft extending in a sheet width direction orthogonal to the sheet feeding direction, and an actuating plate which swings about the swing shaft and makes contact with a back side of the sheet stacking plate, the light shielding member includes an arm portion extending in a radial direction from one end of the swing shaft, the arm portion rotating together with the swing shaft, the optical sensor includes a plurality of the optical sensors arranged in the mount portion along a swing locus of a tip end of the arm portion, and the control portion can sense the remaining quantity of the sheets in a plurality of steps with the optical sensors.

5. The image forming apparatus according to claim 1, wherein the sheet feeding portion includes a pickup roller which makes contact with a topmost sheet of the sheets stored in the sheet storing cassette to feed the sheet, and a sheet feeding roller which is arranged downstream of the pickup roller in the sheet feeding direction to feed the sheet fed by the pickup roller to a sheet conveying passage.

6. The image forming apparatus according to claim 1, further comprising a sheet detection sensor which is provided in the sheet conveying passage and which senses the sheet, wherein during continuous feeding of the sheets by the sheet feeding portion, the control portion controls the sheet feeding portion to start feeding the following sheet with the sheet feeding timing after the sheet detection sensor has sensed the foregoing sheet.

7. The image forming apparatus according to claim 6, wherein the sheet detection sensor is arranged close to a downstream-side part, in the sheet feeding direction, of the sheet feeding portion to sense the tail end of the sheet.

8. The image forming apparatus according to claim 1, wherein the sheet storing cassette includes a tail end cursor which makes contact with and aligns tail ends of the sheets stacked on the sheet stacking plate.

* * * * *